US005988182A

United States Patent [19]

Engelbrecht

[11] Patent Number: 5,988,182

[45] Date of Patent: Nov. 23, 1999

[54] MICROWAVE HEATABLE HAIR ROLLER

[76] Inventor: Tonya Engelbrecht, 651 W. Oakdale, 1A, Chicago, Ill. 60657

[21] Appl. No.: 08/861,551

[22] Filed: May 22, 1997

Related U.S. Application Data

[63] Continuation-in-part of application No. 08/538,023, Oct. 2, 1995, abandoned.

[51] Int. Cl.[6] ..... A45D 2/12; A45D 2/36

[52] U.S. Cl. ..... 132/262; 132/233; 132/267; 132/227

[58] Field of Search ..... 132/227, 229, 132/233, 262, 267

[56] References Cited

U.S. PATENT DOCUMENTS

| | | | |
|---|---|---|---|
| 3,473,005 | 10/1969 | Grandinetti | 132/229 |
| 3,516,421 | 6/1970 | Rosmarin . | |
| 3,533,418 | 10/1970 | Mestral | 132/262 |
| 3,540,457 | 11/1970 | Solomon . | |
| 3,559,658 | 2/1971 | Genest et al. . | |
| 3,624,749 | 11/1971 | Girard et al. | 132/262 |
| 3,766,930 | 10/1973 | Madsen et al. | 132/233 |
| 4,499,355 | 2/1985 | Walter | 132/229 |
| 4,520,832 | 6/1985 | Skovdal | 132/233 |
| 4,538,630 | 9/1985 | Henderson . | |
| 4,627,452 | 12/1986 | Caruso | 132/229 |
| 4,710,609 | 12/1987 | Switlicki . | |
| 4,743,726 | 5/1988 | Hughes et al. . | |
| 4,829,155 | 5/1989 | Fukiutka et al. . | |
| 4,952,360 | 8/1990 | Gibbon . | |
| 5,030,820 | 7/1991 | Gibbon . | |
| 5,297,567 | 3/1994 | Summerville et al. . | |
| 5,299,367 | 4/1994 | Johnson et al. . | |
| 5,375,278 | 12/1994 | VanWinkle et al. . | |
| 5,494,598 | 2/1996 | Hughes . | |

*Primary Examiner*—Todd E. Manahan
*Attorney, Agent, or Firm*—McDonnell Boehnen Hulbert & Berghoff

[57] ABSTRACT

A clipless hair roller that includes a heated metallic inner cylinder and elongated outer plastic cylinder having a plurality of ventilation openings to allow for the efficient and uniform transfer of heat from the metallic inner cylinder to hair associated with the roller.

12 Claims, 3 Drawing Sheets

MICROWAVE HEATABLE HAIR ROLLER

This Application is a continuation-in-part of U.S. patent application Ser. No. 08/538,023, filed Oct. 2, 1995 now abandoned.

FIELD OF THE INVENTION

This invention pertains to heatable hair rollers, and more particularly to electric and microwave heatable hair rollers having hair engaging elements on an outside surface thereof that are long and malleable enough to engage and remain associated with hair without the use of a roller clip.

BACKGROUND OF THE INVENTION

Hair rollers are well known for their use for drying and curling hair. Hair rollers come in a variety of configurations and sizes for all types of hair. Known types of roller are heatable by microwave energy, and by electric energy.

Microwaveable rollers have been made from a variety of materials in a variety of constructions. Examples of microwaveable rollers are those disclosed in U.S. Pat. No. 5,030,820 which describe rollers made from a matrix of a thermoplastic or thermoset material and particulate electromagnetic material such as ferrites and powdered iron. Another known microwaveable hair roller disclosed in U.S. Pat. No. 5,297,567 includes a solid body having a quantity of silicon gel therein for storing heat energy.

Still another microwaveable hair roller which is disclosed in U.S. Pat. No. 4,743,725 has a concentrically wound or tubular, layered composite structure including a water saturated core, a resistive rubber material and a lubricant. The roller can be heated, such as by microwave energy. Other known microwaveable rollers use, for example, a lossy dielectric material or a wicking material to store the microwave energy. Essentially all of the known rollers use some combination of complex structure and/or complex materials to create a hair roller which both withstands the rigors of microwave heating and stores energy for later imparting such energy into a user's hair.

Electrically heated hair rollers are also well known in the art. The well known electrically heated hair rollers are all two piece designs that require the use of a clip or some other attaching device to keep hair from becoming unraveled after it is associated with the electrically heated roller.

Thus, there continues to be a need for a single piece hair roller that is simple in construction, that heats quickly, and that includes hair engaging elements that permit the single piece heatable hair roller to be self-engaging with a swatch of hair.

SUMMARY OF THE INVENTION

A single piece, clipless heatable hair roller is disclosed for releasably engaging and curling a swatch of hair rolled around the roller. Such a roller has a tubular body enclosing a heatable core that is capable of quickly heating up and transmitting heat energy from the core of the roller to hair engaged by the roller.

In one embodiment, the hair roller includes elongated, microwaveable, outer and inner hollow plastic cylinders having inner and outer surfaces. The roller further includes at least one sealing ring disposed between the ends of the outer cylinder and the inner cylinder, defining a first, sealed annular volume and a second, open inner volume. The roller has a microwaveable, energy retaining material sealingly disposed between the outer and inner cylinders in the sealed annular volume, substantially filling the volume. In a preferred form of the invention, the energy retaining material is a grain, such as rice. When subject to microwave energy, the energy retaining material stores the energy and then releases the energy, at least in part, through the outer cylinder, to impart at least a portion of the energy in the form of heat into the swatch of hair rolled therearound.

In a most preferred embodiment of the invention, the roller includes a plurality of hair engaging elements or members extending generally outwardly from the outer surface of the outer cylinder. The hair engaging elements releasably engage the swatch of hair rolled around the roller and permit use of the roller without pins or clips to retain the roller in place in the user's hair. Other features and advantages of the present invention will be apparent from the following detailed description, the accompanying drawings, and the appended claims.

DETAILED DESCRIPTION OF THE PREFERRED EMBODIMENTS

Figure 1:
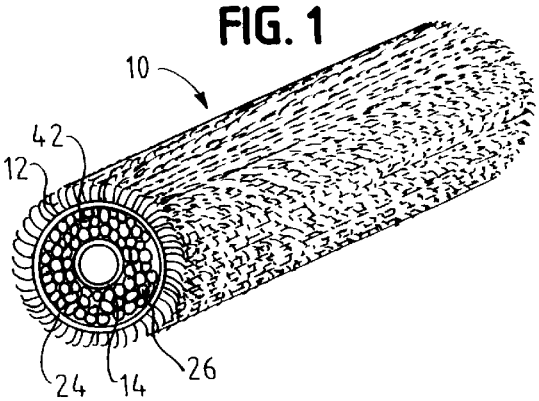
FIG. 1 is a perspective view of a microwave heatable hair roller, having a sealing ring removed, illustrating an open end thereof and illustrated with a plurality of hair engaging elements extending therefrom, in accordance with the principles of the present invention.
Figure 2:
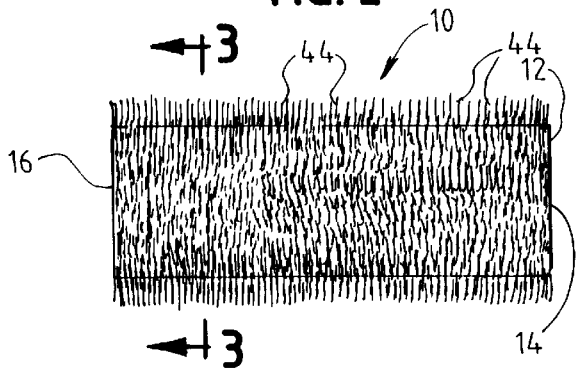
FIG. 2 is a front view of the hair roller of FIG. 1.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to FIG. 1, there is shown an embodiment 10 of a microwave heatable hair roller of the present invention. The roller includes an outer hollow plastic cylinder 12 and an inner hollow plastic cylinder 14.

The outer cylinder 12 has an inner surface 16 and an outer surface 18. Similarly, the inner cylinder 14 has an inner surface 20 and an outer surface 22.

Figure 4:
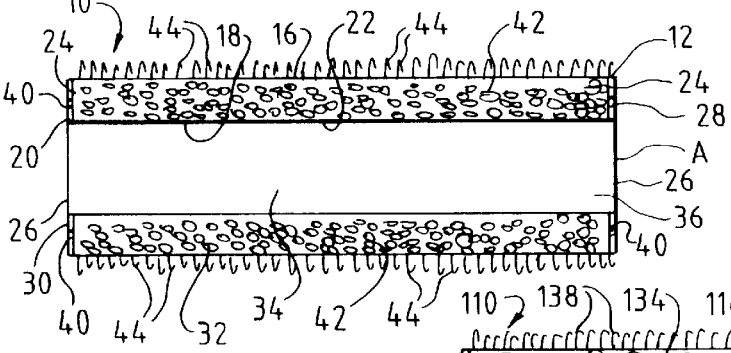
FIG. 4 is a cross-sectional view of the roller of FIG. 2 taken along line 4—4 thereof.

With reference now to FIG. 4, in the illustrated embodiment of the roller 10, each the outer cylinder 12 and the inner cylinder 14 have open ends 24 and 26. In this embodiment, the roller includes a pair of sealing rings 28, 30 located between and connecting the outer and inner cylinders 12, 14. The sealing rings 28, 30 are located at about the open ends 24, 26 of the outer and inner cylinders 12, 14. The cylinders 12, 14 and sealing rings 28, 30 define a first annular volume or space 32 located between the outer and inner cylinders 12, 14, which space 32 is essentially sealed, and an inner volume or space 34 interior of the inner cylinder 14. The inner space 34 defines a passage 36 through the center of the roller 10.

The sealing rings 28, 30 may further include openings 40 therein for ventilating the annular volume 32. The cylinders 12, 14 and sealing rings 28, 30 are formed of a polymeric or plastic material which can withstand exposure to microwave energy for periods of up to several minutes, without significant loss of integrity and without becoming brittle. The roller 10 includes a microwave energy retaining material 42 disposed in the annular volume 32, between the inner surface 18 of the outer cylinder 12 and the outer surface 20 of the inner cylinder 14. The energy retaining material 42 essentially fills the annular volume 32. In the embodiment of the roller 10 shown, the energy retaining material 42 is a plant grain, such as rice, millet or the like other water bearing, organic matter, such as plant materials, can be used to form the energy retaining material.

Still other energy retaining materials 42 may also be used in the hair roller 10. As will be recognized by those skilled in the art, microwaveable beads may be used in lieu of plant materials, or in combination therewith to obtain the optimum energy absorbing and heat emitting characteristics. Exemplary of such microwaveable beads are those sold under the trade name "thermo-beads" offered by the Bruder Health Care Company of Marietta, Ga.

It is preferred that the energy retaining material 42 have a size which is greater than the openings 40 in the sealing rings 28, 30, and a shape so that the inventory of the material 42 in the roller 10 is not lost. It will be recognized by those skilled in the art that such materials 42 can replaced or refilled as needed if the inventory of material 42 declines over time.

Figure 3:
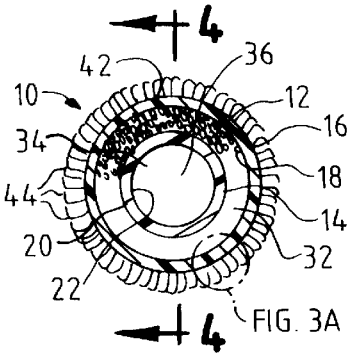
FIG. 3 is a is a cross-sectional view of the hair roller of FIG. 2, taken along line 3—3 of FIG. 2.
Figure 3A:
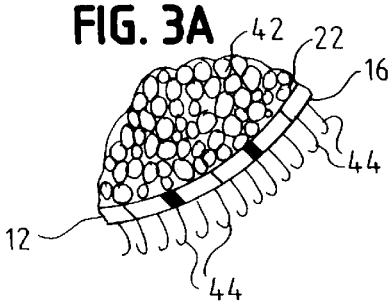
FIG. 3A is an enlarged view of the area illustrated in FIG. 3, showing the configuration of exemplary hair engaging members positioned on the roller.

In a preferred embodiment, the roller 10 includes a plurality of flexible, hair engaging members 44 which extend generally outwardly from the outer surface 16 of the outer cylinder 12. As illustrated in FIG. 3A, the hair engaging members 44 may have a hooklike configuration, similar to the hook-like members of known hook and loop type mechanical fastening systems. The hair engaging members 44 engage a swatch of hair 10 which is wound or rolled around the roller 10, without the use of clips or other devices to retain the hair in place.

Advantageously, such a "clipless" roller permits the energy which would otherwise be lost to 15 conduction through such a clip, particularly if the clip is formed of a metallic, conducting material, to be imparted to the swatch of hair. Hence, the clipless roller increases the efficiency of the roller in use. The hair engaging members 44 may be randomly located on the surface 16 of the outer cylinder 12. Alternately, the hair engaging members 44 may be located on the outer surface 16 in rows which extend longitudinally along the surface 16, radically along the surface 16 and essentially covering the entire surface 16. All such configurations or placements of the hair engaging members 44, as well as other configurations which will be readily recognized by those skilled in the art, are within the scope of the present invention.

Figure 5:
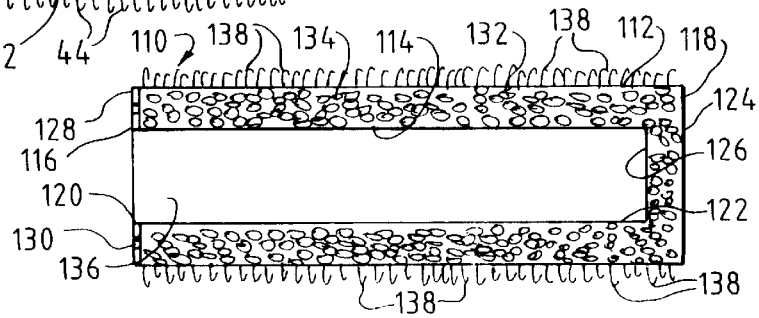
FIG. 5 is a cross-sectional view of an alternate embodiment of the hair roller having inner and outer cylinders each having an open end and a closed end.
Figure 6:
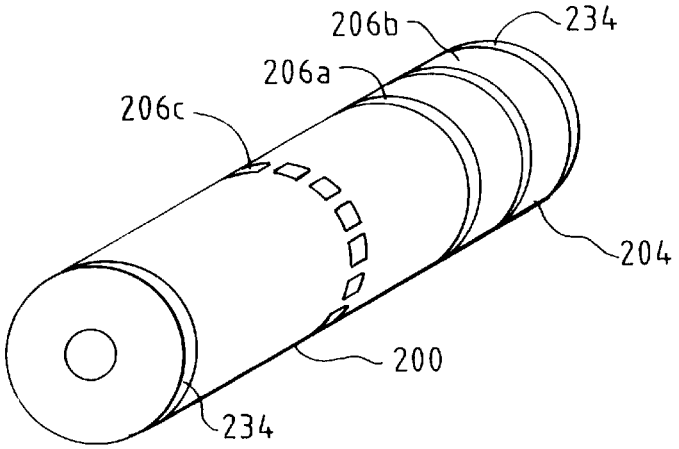
FIG. 6 is a perspective view of an electrically heated self-adhering hair roller showing various configurations of ventilation openings associated with the elongated outer plastic cylinder.
Figure 7:
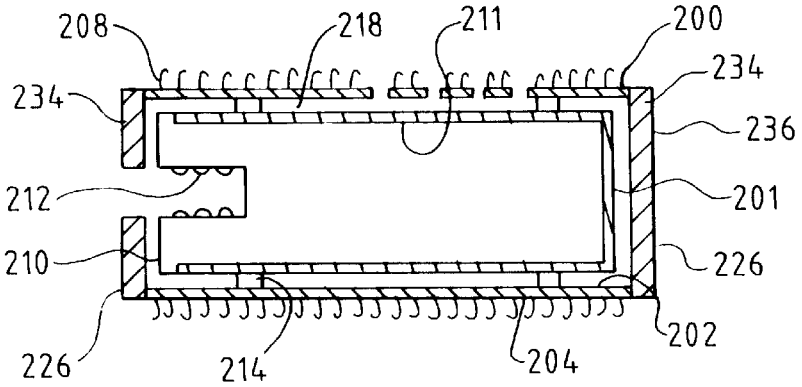
FIG. 7 is a side cut away view of an embodiment of a self-adhering electrically heatable hair roller of this invention.
Figure 8:
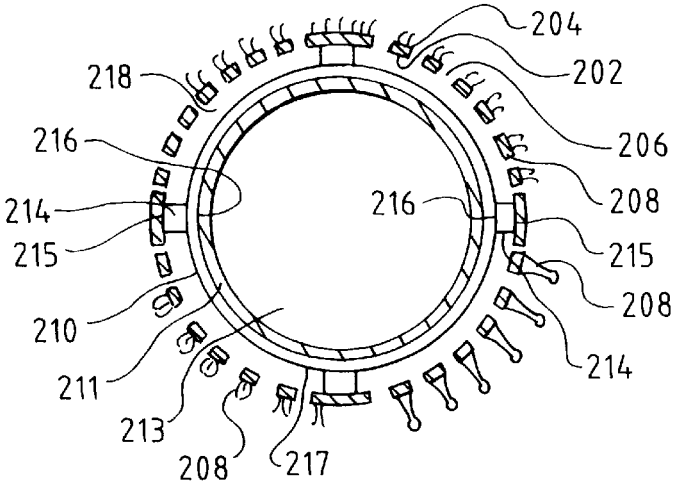
FIG. 8 is an end cross section view of an embodiment of a self-adhering electrically heatable hair roller of this invention including various useful hair engaging members.

An alternate embodiment 110 of the hair roller is illustrated in cross-section FIG. 5. Like the embodiment 10, the roller 110 includes an outer cylinder 112 and an inner cylinder 114. Each the outer cylinder 112 and inner cylinder 114 have an open end 116, 118 and a closed end 120, 122. The closed ends 120, 122 are formed by walls 124, 126 which may be formed integral 7 with the respective cylinders 112, 114. The inner and outer cylinders 112, 114 are connected by a sealing ring 128 which is positioned between the cylinders 112, 114 at about their respective open ends 116, 120. The sealing ring 128 may include ventilating openings 130 therein. Alternately, the walls 124, 126 may include such ventilating openings (not shown). The outer and inner cylinders 112, 114 and sealing ring 128 define a first annular volume 132 which has disposed therein an energy retaining material 134 such as that provided in the roller 10. The inner cylinder defines 114 an open inner volume 136. The roller 110 may be sealed or it may be configured to permit access to the annular volume 136 to replace the energy retaining material 134, as needed. The roller 110 may also be provided with hair engaging members 138 positioned or formed on the outer surface of the outer cylinder 112.

Referring to FIGS. 6–11, there are shown embodiments of self-adhering electric heatable hair rollers of this invention. The self-adhering electrically heatable hair roller 201 includes an elongated outer plastic cylinder 200 having an inner surface 202 and an outer surface 204. Elongated outer plastic cylinder 200 also has at least one and preferably a plurality of ventilation openings 206. Self adhering electrically heatable hair roller 201 further includes a metallic inner cylinder 210. Metallic inner cylinder 210 includes an electric heating element engaging member 212 associated with an open end of elongated outer plastic cylinder 200. In addition, self adhering electrically heated hair roller 201 optionally includes at least one and preferably a plurality of insulators 214 having a top surface 215 and a bottom surface 216. Insulators 214 separate elongated outer plastic cylinder 200 from metallic inner cylinder 210. A plurality of hair engaging members 208 are located on outer surface 204 of elongated outer plastic cylinder 200. Hair engaging members 208 allow the self-adhering electrically heatable hair roller 201 to engage a hair swatch without the use of a clip.

Elongated outer plastic cylinder 200 includes ventilation openings 206 that allow heat generated by metallic inner cylinder 210 to pass through elongated outer plastic cylinder 200 where it is able to heat hair engaged with hair engaging members 208. Ventilation openings 206 may be in the form of radial ventilation openings 206*a,* lateral ventilation openings 206*b,* in a checkerboard pattern 206*c* or in any other pattern or form that allows heat to uniformly pass from metallic inner cylinder 210 to a swatch of hair associated with the self-adhering roller. For instance, an elongated outer plastic cylinder with a sponge like plastic surface having randomly located ventilation openings is adaptable for use in the self-adhering curler of this invention.

In order to provide a sufficient amount of heat to curl a swatch of hair, it is preferred that the ventilation openings comprise from about 15% to 75% of the surface area of elongated outer plastic cylinder 200. Most preferably, ventilation openings 206 should comprise from about 25% to 50% of the surface area of elongated outer plastic cylinder 200. Ventilation openings 206 can pass directly through elongated outer plastic cylinder 210 or they may pass through elongated outer plastic cylinder such as when elongated outer plastic cylinder 210 is constructed of a sponge-like material.

Figure 10A:
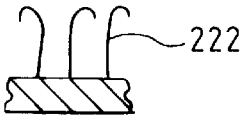
FIGS. 10*a*–10*c* depict various hair engaging members useful in association with self-adhering electrically heatable hair rollers of this invention.
Figure 10B:
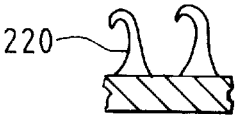
Figure 10C:
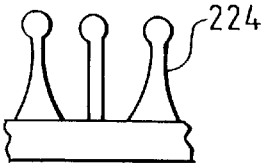

Outer surface 204 of elongated plastic cylinder 200 includes a plurality of hair engaging members 208. The hair engaging members, should be uniformly distributed over outer surface 204 and may be in any form and number sufficient to allow the self-adhering hair roller to adhere to a swatch of hair without the use of a clip. Non-limiting examples of usefull hair engaging members 208 are depicted in FIGS. 10*a*–10*c* and include tapered hooks 220, non-tapered hooks 222, such as the hook portion of push and hook connectors sold under the name VELCRO, and ball-topped rods 224. It is preferred that the hair engaging members are tapered hooks 220. While the orientation of the tapered hooks and other hair engaging members is not crucial for the effectiveness of the roller, it is preferred that the tapered hooks 220 are uniformly orientated in one direction. By uniformly orientated it is meant that the oriented in the same direction, not in a random manner. In addition, it is preferred that the taper hooks are integral to and manufactured out of the same plastic as elongated outer plastic cylinder 200. Manufacturing elongated outer plastic cylinder 200 with integral tapered hooks will reduce the manufacturing complexity and cost of the elongated outer plastic cylinder 200.

Elongated outer plastic cylinder 200 is preferably manufactured of plastic in order to act as a heat insulator to prevent a person handling the roller from being burned and to prevent the roller from damaging a hair swatch during the curling process. In addition, elongated outer plastic cylinder 200 is preferably manufactured of a plastic material that is malleable to facilitate movement of hair engaging members 208 when they engage and disengage a swatch of hair.

Metallic inner cylinder 210 of the self adhering electrically heatable hair roller 201 is manufactured from a material that can be heated quickly by electrical resistance heating or by conduction. Such metals include aluminum, copper, iron, alloys thereof and any other metals known to one skilled in the art to be capable of becoming heated quickly by electrical resistance hearing. A preferred metal is aluminum and aluminum alloys. The purpose of metallic inner cylinder 210 is to quickly heat to a desired temperature and thereafter quickly radiate heat from the inner portion of the self adhering hair roller through ventilation openings 206 and into a swatch of hair engaged with the roller. Metallic inner cylinder 210 must also cool quickly to avoid overheating a hair swatch.

Figure 11A:
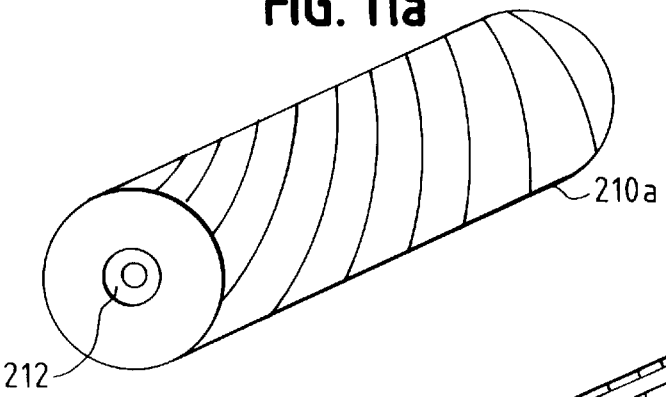
FIGS. 11*a,* 11*b,* and 11*c* depict various metallic inner cylinders useful in the self-adhering electrically heatable hair rollers of this invention.
Figure 11B:
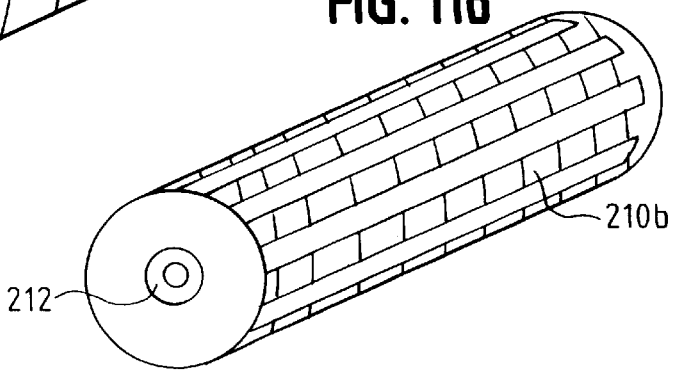
Figure 11C:
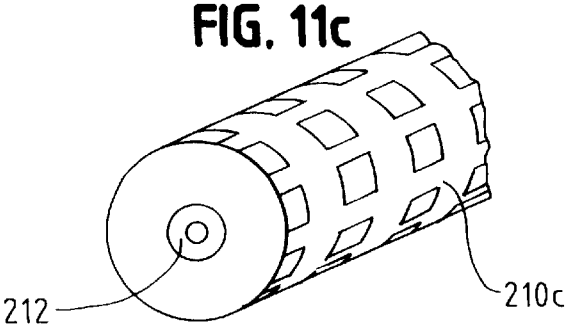

Metallic inner cylinder 210 can have a variety of configurations that allow metallic inner cylinder to heat quickly and cool quickly. Metallic inner cylinder 210 can be solid as shown in FIG. 11*a*. When metallic inner cylinder 210 is solid, then the thickness of the metal used to manufacture metallic inner cylinder may be adjusted to obtain the desired heating and cooling rates. Alternatively, metallic inner cylinder 210 can consist of a columns attached to two opposing bases as shown in FIG. 11*b*. In still another design, metallic inner cylinder my be mesh shaped as shown in FIG. 11*c*. The mesh size may vary from a thick mesh design as shown in FIG. 11*c* to a very thin mesh such as that used in a sieve or window screen.

In order to facilitate the transfer of heat to a hair swatch and in order to prevent elongated outer plastic cylinder from melting as a result of the heat generated by metallic inner cylinder 210, the self adhering electrically heated hair roller of this invention preferably includes at least one insulator 214 located between metallic inner cylinder 210 and elongated outer plastic cylinder 200. Insulator 214 includes a top surface 215 and a bottom surface 216. Top surface 215 abuts inner surface 202 of elongated outer plastic cylinder 200 while bottom surface 215 abuts metallic inner cylinder 210. The association of insulation 214 with elongated outer plastic cylinder 200 and metallic inner cylinder 210 defines a gap 218 dividing metallic inner cylinder 210 from elongated outer plastic cylinder 200. It is preferred that gap 218 have a height from 0.05 to about 0.35 inches and preferably from about 0.1 to about 0.25 inches. In order to facilitate the transfer of heat to a hair swatch via ventilation openings 206 while at the same time preventing the elongated outer plastic cylinder from melting.

Insulator 214 may be manufactured of any material having insulating properties that is capable of withstanding the heat generated by metallic inner cylinder 210. Examples of useful insulators include rubbers, ceramics, polymer foams, polymers and thermoset plastics. It is preferred that insulator 214 is a uniform layer of heat permeable polymer. By uniform, it is meant that the layer of polymer entirely covers metallic inner cylinder 210. The uniform polymer layer can have any type of surface texture from a sponge like surface to a slick surface to a plush surface. Altematively, a plurality of insulators used to separate elongated outer plastic cylinder 200 from metallic inner cylinder 210. As with ventilation openings 206, the plurality of insulators 214 may be orientated radially, laterally, in a mesh pattern, or in any other pattern that is adequate to separate elongated outer plastic cylinder 200 from metallic inner cylinder 210 without greatly inhibiting the transfer of heat from metallic inner cylinder 210 into a swatch of hair.

Figure 9A:
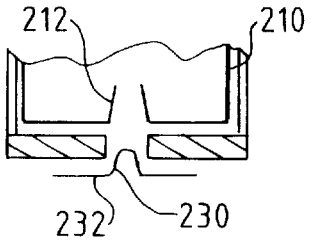
FIGS. 9*a*–9*c* depict embodiments of electric heating element engaging members useful in the self-adhering electrically heatable hair rollers of this invention.
Figure 9B:
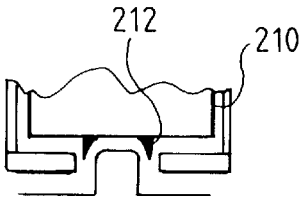
Figure 9C:
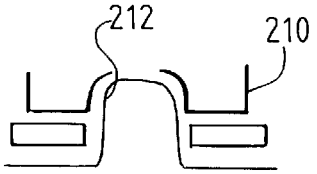

Metallic inner cylinder 210 includes an electric heating element engaging member 212 associated with one and of metallic inner cylinder 210. FIGS. 9*a*–9*c* depict examples of electric heating element engaging members 212. Electric heating element engaging member can be configured such that it is complimentary to an electric heating element 230 associated with a hair roller base 232. Hair roller base 232 also includes an electrical cord that can be associated with an electrical outlet. When the electrical cord is plugged into an electric outlet, the electric heating element 230 may be associated with electric heating element engaging member 212 in order to heat the self-adhering heatable hear rollers of this invention.

Self-adhering heatable hair rollers of this invention may include an inner reflecting surface 211 that reflects heat radiated by metallic inner cylinder 210 outwardly towards a hair swatch that is engaged to the self-adhering heatable hair roller. Reflecting surface 211 may be manufactured of any material capable of reflecting heat radiated by metallic inner cylinder 210 outwardly such as metals and high melting point plastics. Reflecting surface 211 is located inside the core 213 of metallic inner cylinder 210 and should have a shape complementary to metallic inner cylinder 210. It is preferred that reflecting surface 211 abuts inner surface 217 of metallic inner cylinder 210.

Self-adhering heatable hair rollers of this invention may include additional safety elements to protect a hair roller user from being burned by metallic inner cylinder 210. For example, self-adhering hair roller 201 may include finger rails 234 located at the ends of the cylindrical roller. In addition, the self adhering hair roller may include one or more caps 236 that isolate metallic inner cylinder 210.

The self adhering electrically heatable hair roller of this invention is used by placing the electric heating element engaging member 212 into contact with the heating elements 230 in roller base 232. The electric cord associated with the roller base 232 is plugged in allowing the metallic inner cylinder 210 to quickly heat, when the metallic inner cylinder 210 reaches the desired temperature, self-adhering roller 201 is removed from roller base 232 and hair engaging members 208 are engaged with a hair swatch. Self-adhering roller 201 is then released at which point it is allowed to remain engaged to the hair swatch for a period of time ranging from about 30 seconds to about 10 minutes to allow heat to transfer from metallic inner cylinder 210 through ventilation opening 206 and into the hair swatch. Once the desired amount of time is passed, self-adhering hair roller 201 is disengaged from the hair swatch to give a curled hair swatch.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

EXAMPLE

A clip-type electrically heated hair roller embodiment of this invention set forth in FIGS. 7–10 including mesh-type ventilation openings, tapered hook hair engaging members and single uniform insulator was associated with a source of electricity and heated to normal operating temperatures. Normal operating temperature is a metallic inner cylinder temperature that is sufficient to heat a swatch of hair engaged with the roller to a temperature of from about 120–160° F. The hair roller was associated with a swatch of hair without the use of a clip and remained in contract with the hair swatch for about 5 minutes. After 5 minutes, the roller was disengaged from the swatch of hair.

The swatch of hair exhibited an acceptable curl. In addition, the delicate tapered hooks were unaffected by the heat generated by the metal inner cylinder of the hair roller.

What I claim is:

1. A one-piece electrically heatable hair roller comprising:

a. an elongated outer plastic cylinder having a inner surface an outer surface and at least one open end, and including a plurality of ventilation openings wherein the ventilation openings make up from about 15 to about 75 percent of the surface area of the elongated outer plastic cylinder;

b. a plurality of hair engaging members located on the outer surface of the outer plastic cylinder;

c. a metallic inner cylinder including an electric heating element engaging member; and d. at least one insulator having an inner surface abutting the metallic inner cylinder, and an outer surface abutting the inner surface of the elongated outer plastic cylinder such that a gap is created between the outer plastic cylinder and the metallic inner cylinder.

2. The one piece electrically heatable hair roller of claim 1 wherein the ventilation openings make up from about 25 to about 50 percent of the surface area of the elongated outer plastic cylinder.

3. The one piece electrically heatable hair roller of claim 1 wherein the gap has a height of from 0.05 to about 0.35 inches.

4. The one piece electrically heatable hair roller of claim 3 wherein the gap has a height of from about 0.1 to about 0.25 inches.

5. The one piece electrically heatable hair roller of claim 1 wherein the ventilation openings are oriented radially, laterally, in a checkerboard pattern, or a combination thereof.

6. The one piece electrically heatable hair roller of claim 1 wherein the roller includes a plurality of radially oriented insulators.

7. The one piece electrically heatable hair roller of claim 1 wherein the roller includes a plurality of laterally oriented insulators.

8. The one piece electrically heatable hair roller of claim 1 wherein the hair engaging members are selected from tapered hooks, ball-topped rods, non-tapered hooks, and combinations thereof.

9. The one piece electrically heatable hair roller of claim 8 wherein the hair engaging members are tapered hooks.

10. The one piece electrically heatable hair roller of claim 9 wherein the tapered hooks are each oriented essentially identically.

11. The one piece electrically heatable hair roller of claim 1 including plastic end coverings.

12. A one-piece electrically heatable hair roller comprising:

a. an elongated outer plastic cylinder having a inner surface an outer surface and at least one open end and including a plurality of ventilation openings oriented in a checkerboard pattern such that the ventilation openings make up from about 15 to about 75 percent of the surface area of the elongated outer plastic cylinder;

b. a plurality of uniformly oriented tapered hooks located on the outer surface of the outer cylinder;

c. a metallic inner cylinder including an electric current engaging member; and d. an insulator having an inner surface abutting the metallic inner cylinder, and an outer surface abutting the inner surface of the elongated outer cylinder such that an gap having a height of from about 0.1 to about 0.25 inches is created between the outer plastic cylinder and the metallic inner cylinder.

* * * * *